United States Patent [19]

Davidson

[11] 4,134,583

[45] Jan. 16, 1979

[54] STARTING ASSIST DEVICE FOR SWIMMERS

[76] Inventor: James J. Davidson, 242 Welches Point, Milford, Conn. 06460

[21] Appl. No.: 782,635

[22] Filed: Mar. 30, 1977

Related U.S. Application Data

[63] Continuation-in-part of Ser. No. 665,283, Mar. 9, 1976, abandoned.

[51] Int. Cl.[2] ..... A63K 3/02

[52] U.S. Cl. ..... 272/4; 272/71; 272/105

[58] Field of Search ..... 272/71, 4, 26, 100, 272/105, 1 B, 65, 66, 111; 114/219; 9/1.6, 1.7, 301, 303, 310 J, 46, 400; 4/172; 14/76

[56] References Cited

U.S. PATENT DOCUMENTS

| | | | |
|---|---|---|---|
| 1,793,898 | 2/1931 | Barron | 272/105 |
| 2,578,291 | 12/1951 | Dickson, Jr. | 114/219 |
| 2,875,528 | 3/1959 | Garate | 272/71 X |
| 3,083,964 | 4/1963 | Wentzel | 272/111 |
| 3,140,550 | 7/1964 | Wayfield | 272/71 UX |
| 3,263,168 | 7/1966 | Rainer | 272/71 UX |
| 3,404,534 | 10/1968 | Cunney | 14/76 X |
| 3,733,630 | 5/1973 | Bagley | 272/1 B UX |
| 3,784,768 | 1/1974 | Hunt | 272/4 X |
| 3,799,542 | 3/1974 | Potgieter | 272/105 |
| 3,809,392 | 5/1974 | Kral, Jr. | 272/105 X |
| 3,916,214 | 10/1975 | Coble, Jr. et al. | 272/4 X |
| 3,944,763 | 3/1976 | Beierwaltes | 272/4 X |

FOREIGN PATENT DOCUMENTS

| | | | |
|---|---|---|---|
| 924167 | 2/1955 | Fed. Rep. of Germany | 272/111 |
| 2301379 | 7/1974 | Fed. Rep. of Germany | 272/66 |
| 2358876 | 2/1975 | Fed. Rep. of Germany | 272/1 B |
| 581839 | 10/1946 | United Kingdom | 272/71 |

*Primary Examiner*—Richard C. Pinkham
*Assistant Examiner*—Arnold W. Kramer
*Attorney, Agent, or Firm*—Mattern, Ware, Davis & Stoltz

[57] ABSTRACT

By providing a ramped plate which is removably positioned in a swimming pool directly abutting the swimming pool wall with the ramped plate forming an acute angle therewith, a starting assist device is provided for backstroke swimmers by which they can securely position their feet during the start of their swim. Preferably, this starting assist device incorporates a support assembly for supportingly maintaining the device underwater during the start of the swim with said support assembly having at least one member extending out of the water for easy removability of the device after the swimmer has begun.

17 Claims, 5 Drawing Figures

STARTING ASSIST DEVICE FOR SWIMMERS

RELATED APPLICATION

This application is a continuation-in-part application of the U.S. patent application of James J. Davidson for Starting Assist Device for Swimmers, bearing Ser. No. 665,283, filed Mar. 9, 1976, which application is now abandoned.

BACKGROUND OF THE INVENTION

This invention relates to starting devices for swimmers, and more particularly to underwater starting devices for backstroke swimmers.

Although a need for some type of starting aid for backstroke swimmers has long existed, no such device of any type has been made. In spite of the fact that starting blocks for track events and starting blocks for swimmers leaving above the swimming pool and entering the pool after the start of the race do exist in the art, no device of any type has been made available for backstroke swimmers or any type of swimmer when his swim is initiated inside the swimming pool itself.

The problems that exist with backstroke swimmers in preparing for the start of their swim are extremely acute and require some type of assisting device. When a backstroke swimmer crouches with his feet on the wall of the swimming pool, poised for the start of this swim, only his toes and a small portion of his feet are in contact with the pool wall. Consequently, the fear of slipping at the critical start time is prevalent and realistic threat.

Consequently, it is a principal object of this invention to provide a starting assist device which provides support to a major portion of the foot of a backstroke swimmer during the start of his swim.

Another object of this invention is to provide the starting assist device described in the foregoing objects which is easily and quickly positioned in the swimming pool as well as removed from the swimming pool after it has been used.

Another object of this invention is to provide a starting assist device as described in the foregoing objects which is easily positionable in the swimming pool at any level.

A further object of this invention is to provide a starting assist device as described in the foregoing objects wherein a secure, rigid platform is provided for the feet of the backstroke swimmer during his start in order to eliminate any subconscious fear of slipping.

Other and more specific objects will in part be obvious and will in part appear hereinafter.

SUMMARY OF THE INVENTION

The starting assist device of the present invention meets all of the prior art needs by providing a ramped, support platform which is quickly and easily positioned in a swimming pool for the start of the backstroke swim, and then easily removed from the pool after its use. The starting assist device is designed to assure removal from the pool in at least 10 seconds, although its removal may be achieved in 3–5 seconds. When in the pool, the ramped support surface provides the backstroke swimmer with a firm and secure surface upon which the swimmer can comfortably and securely position his feet, ready for the start of his swim.

In the preferred embodiment, the starting assist device of this invention comprises an overall triangular or wedge-like shape with one surface comprising the support platform and another surface comprising a pool abutting surface. Furthermore, the device incorporates support means which are mounted at one end at some location outside of the pool itself with the other end secured to the starting assist device. In this way the starting assist device is quickly and easily positioned in the pool in the desired location, and also quickly and easily removed from the pool after its use.

Once the starting assist device of the present invention has been used in a race by a swimmer, it is important that the starting assist device be quickly removed from the pool. This is required in order to eliminate any protrusions extending from the pool walls, which may injure a swimmer, and to eliminate any object which may interfere with the automatic timing systems. Consequently, the starting assist device of the present invention is designed to be removable from the pool within a minimum of ten seconds, although its removal can be effectuated in substantially less time. Of course, if removal is not required, for some reason, the starting assist device can be merely left in position, ready for its next use.

Preferably, the starting assist device is adjustably supported in the pool, in order to allow the device to be located about one-half inch below the water surface. In this position, the toes of the swimmer are comfortably positionable above the water surface, as required by intercompetition rules, while the remainder of the swimmer's feet securely rest on the ramped support surface.

By employing the starting assist device of the present invention, the constant threat of slipping during the start of a race is completely eliminated, and the backstroke swimmer can concentrate completely on his form and his "push-off" execution and follow through without any conscious or subconscious fear of disaster, by slipping, by striking.

The invention accordingly comprises an article of manufacture possessing the features, properties, and the relation of elements which will be exemplified in the article hereinafter described, and the scope of the invention will be indicated in the claims.

THE DRAWINGS

Figure 3:
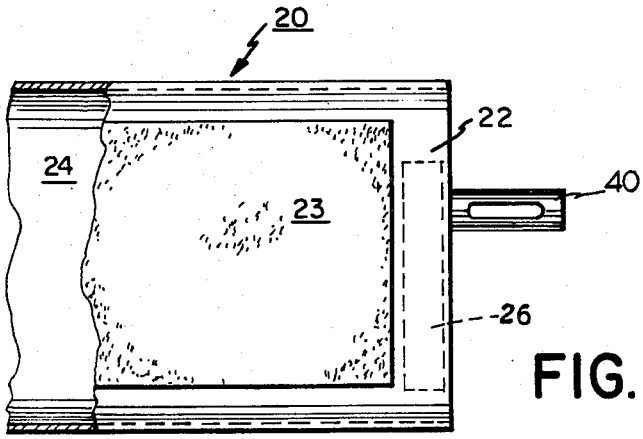
Figure 4:
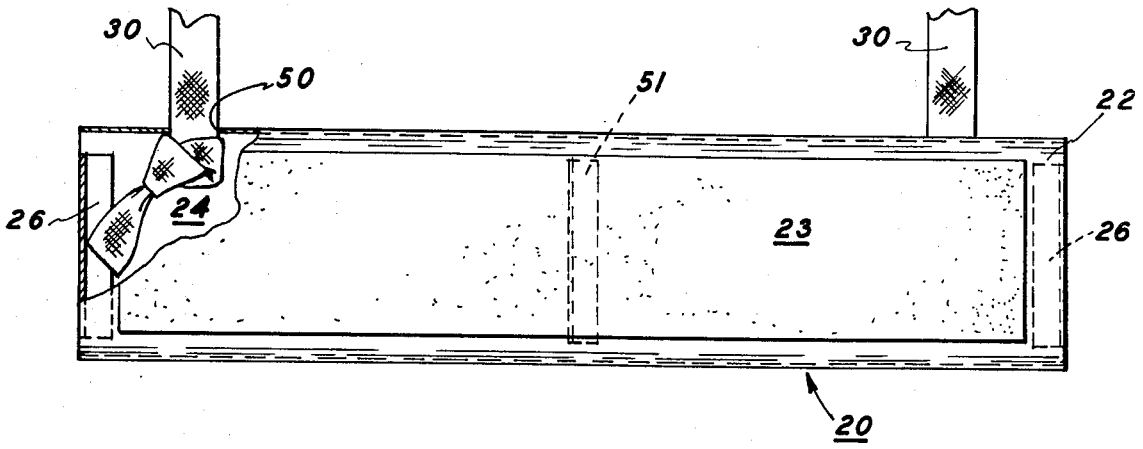
Figure 5:
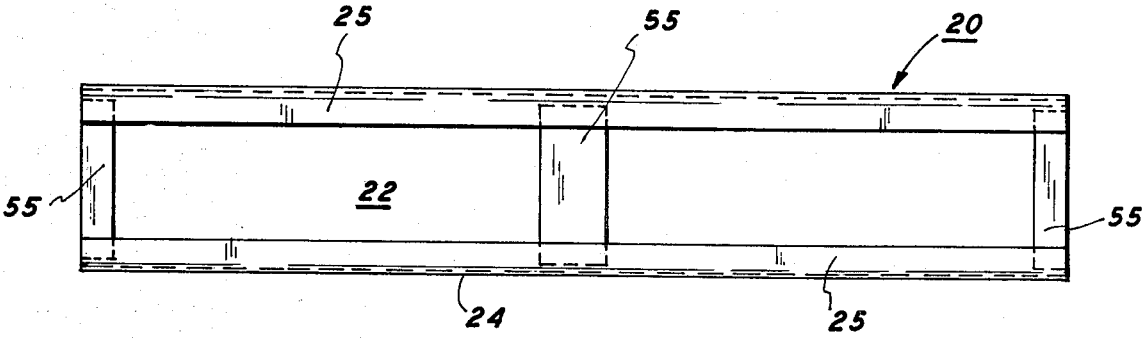

FIG. 3 is a front elevation view, partially broken away, of an alternative embodiment of the starting assist device of the present invention, FIG. 4 is a front elevation view, partially broken away, of a further alternative embodiment of the starting assist device of the present invention; and FIG. 5 is a bottom elevation view, partially broken away, of the embodiment of FIG. 4 of the starting assist device of the present invention.

DETAILED DESCRIPTION

Figure 1:
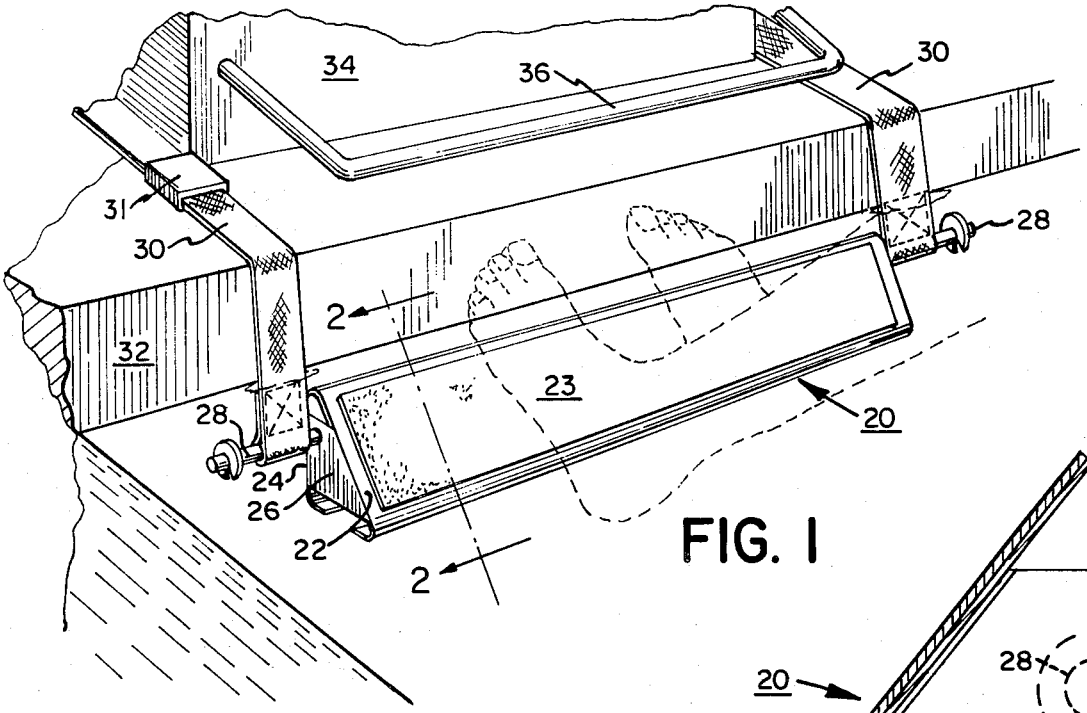
FIG. 1 is a perspective view of the starting assist device of the present invention positioned in a typical swimming pool with the swimmer's feet shown in phantom.

As shown in FIG. 1, starting assist device 20 comprises a ramped surface 22, a pool abutting surface 24, and stiffening plates 26. In the embodiment shown in FIG. 1, starting assist device 20 incorporates support rods 28 extending from stiffening plates 26 and adjustable belt 30 which securely maintains starting assist device 20 in any desired position.

In order to allow starting assist device 20 to be securely maintained in position at any particular level in the water of the swimming pool, the preferred embodiment incorporates adjustable belt 30 in combination with pin assembly 28. In this embodiment, belt 30 is looped around a fixed block 34 which is secured to the outer peripheral surface of the swimming pool. Belt 30 is then adjusted employing buckle 31 so that starting assist device 20 is submerged below the water line at the precisely desired level. In this way, starting assist device 20 is maintained in its necessary position, regardless of where block 34 is positioned, the size of block 34, or the level of the water in the swimming pool.

Generally, it has been found that starting assist device 20 should be maintained at about one-half inch below the surface of the water in order to provide the desired support to the swimmer while also allowing the swimmer to have his toes emerging from the water, in accordance with general practice and specific rules controlling intercompetition for backstroke swimmers. Furthermore, in accordance with these controlling rules, all devices which extend from the vertical wall 32 of the swimming pool must be removable in order to be accepted by the controlling authorities. As a result, starting assist device 20 is quickly and easily positionable in the precisely desired level in the water, regardless of external conditions, is securely maintained in that position, is quickly and easily removed from the pool after use by the swimmer.

Figure 2:
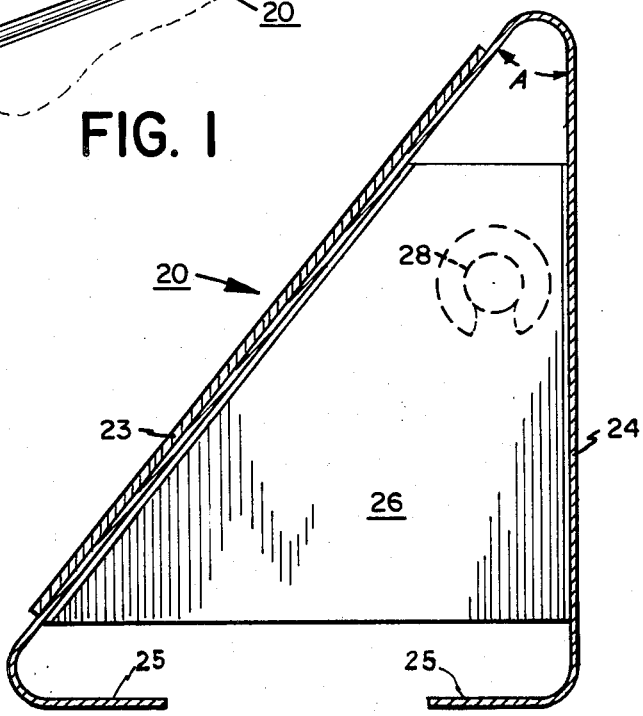
FIG. 2 is a cross-sectional side elevation view of the starting assist device of the present invention taken along line 2—2 of FIG. 1.

Although the starting assist device of the present invention can be manufactured in a variety of ways, the preferred construction for starting assist device 20 can best be understood by referring to FIG. 2. In this preferred construction, a single sheet of non-corrosive material, preferably stainless steel, is formed into a substantially triangular, wedge-like configuration. This elongated triangular wedge incorporates a substantially flat surface 24 as a leg of the triangle for abutting the vertical wall of the swimming pool, a ramped surface 22 as the hypotenuse for providing the desired supporting platform for the backstroke swimmer, and base members 25 as the other triangle leg which incorporate the terminating edges of the original sheet of material in order to prevent any sharp edges from protruding into areas which may be injurious to the swimmer. The construction is then completed by securely mounting stiffening plates 26 along the vertical ends of the elongated sheet of material with said stiffening plates being attached to the inner wall of surface 24 and ramped surface 22. In this way, any flexibility of ramped surface 22 is substantially eliminated and a firm, secure supporting platform is achieved.

Included angle A between ramped surface 22 and pool abutting surface 24 must be maintained at an angle which generally conforms to the angle that the feet of the typical backstroke swimmer forms with the wall of the swimming pool when the swimmer is poised for the start of his swim. It has been found that desirable results are achieved when included angle A is between 20 and 75 degrees. However, most swimmers appear to be most comfortable when included angle A is between 30 and 60 degrees.

It is important to note, that included angle A can range between at least 10 and 80 degrees, without causing any inconvenience or apparent difficulty for the swimmer. However, since the majority of swimmers appear to have an angular relationship between their feet and the vertical wall of the swimming pool ranging between 30 and 60 degrees, this is the range employed for providing the most universal starting assist device.

Another factor which must be considered in the construction of starting assist device 20 and the angular relationship of ramped surface 22 to surface 24 (or to wall 32 of the swimming pool) is the forces generated by the swimmer during his "push-off" and the transferal and absorption of these forces. If a force diagram were constructed for ramped surface 22 for a variety of angles A from 0 to 90 degrees, it is apparent that as angle A is increased to 90 degrees the vertical force component becomes increasingly dominant and must be absorbed by securing strap 30 and rods 28. Alternatively, as angle A is reduced, the horizontal component force increases, resulting in increased forces on vertical wall 32 of the swimming pool.

Although starting device 20 is constructed in a manner which is capable of successfully enduring both the vertical and horizontal components of forces regardless of their magnitude, it is important to note that if angle A is too small, the forces on wall 32 of the swimming pool increase and the possibility of horizontal slippage of starting assist device 20 along wall 32 of the swimming pool becomes and increasingly greater problem, especially if the swimmers' push-off thrust is not substantially perpendicular to wall 32. Consequently, although angle A could conceivably be less than 10 degrees, or even 10–20 degrees, this construction is not preferred because of the potential force-produced slippage that may be encountered. As a result, included angle is preferably greater than 20 degrees or at least 30 degrees.

In order to further enhance the secure, slip-free starting assist device construction of this invention for backstroke swimmers, starting assist device 20 also incorporates, in its preferred embodiment, a slip-free surface 23 which is secured to the ramped surface 22 along its entire length, as shown in FIGS. 1 and 3. In this way, the psychological effect of having a fear of slipping during the critical start moments is completely eliminated, and the swimmer can position himself on starting assist device 20 with his hands grasping bar 36, assured in his own mind that he is securely positioned and will have no difficulty in pushing off from his starting crouch without slipping or sliding in any undesirable manner.

In FIG. 3, the alternative embodiment of starting assist device 20 is shown. In this embodiment, starting assist device 20 incorporates clip member 40 which is mounted to and extends from stiffening plate 26. By employing clip member 40, alternative supporting means can be used which easily hook or clip through member 40 in order to securely hold starting assist device 20 in the desired position. For the reasons described above, any such securement member would also incorporate adjusting means for allowing starting assist device 20 to be positioned at any desired level in the swimming pool below the water surface.

In FIGS. 4 and 5, a further alternative embodiment of starting assist device 20 is shown. In this embodiment, starting assist device 20 incorporates apertures 50 which are formed along the top edge of starting assist device 20 at the intersection of ramped surface 22 with pool abutting surface 24. In this embodiment, starting assist device 20 is securely held and supported in position in the swimming pool by employing strap means or belt 30 which is threadedly engaged with apertures 50, at the terminating ends of belt 30, and securely held within apertures 50 in order to prevent removal therefrom. Belt 30 can be retained within apertures 50 in a variety of fashions, such as merely tying the ends of belt 30 as is shown in FIG. 4. Of course, many other securement methods which are well known in the art, such as dowels or pins can be employed to prevent belt 30 from slipping through apertures 50.

As shown in FIGS. 4 and 5, this embodiment of starting assist device 20 further incorporates a stiffening plate 51 which is substantially centrally mounted along starting assist device 20. In the preferred embodiment, stiffening plate 51 is employed in combination with stiffening plates 26, which are secured along the vertical ends of device 20 as described above. Stiffening plate 51 is preferably tack welded to both the inner wall of surface 24 and ramp surface 22. Although tack welding is preferred, any type of securement means can be employed for securely positioning and maintaining stiffening plates 26 and 51 in their desired positions.

Furthermore, in order to increase the rigidity and prevent any undesirable injury to the swimmer, bracing arms 55 are mounted along base members 25. Bracing arms 55 have been found to increase the rigidity of starting assist device 20, while also substantially eliminating any undesirable injury to the swimmer's foot, caused by unwanted entry into the open area of starting assist device 20 and contacting any sharp edges. As a result, potential injury to the swimmer is eliminated while also assuring greater strength and rigidity to the entire starting assist device construction.

As would be obvious to one skilled in the art, a variety of supporting members and securement equipment can be employed in order to securely suspend starting assist device 20 in its desired position while still assuring ease of removability after its use, without departing from the scope of this invention.

It will thus be seen that the objects set forth above, among those made apparent from the preceding description, are efficiently attained and, since certain changes may be made in the above article without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. A starting assist instrument for supportingly assisting backstroke swimmers during the initial, starting push-off from a swimming pool wall, comprising:

(A) support means incorporating foot supporting surface means for maintaining at least a portion of the swimmer's foot in spatial relationship to the vertical wall of the swimming pool and at an acute angle thereto; and (B) means for positioning the support means in the water and permitting removal of the support means within ten seconds, whereby the backstroke swimmer is provided with a firm and secure support at the start of a race while also having the area completely clear when the swimmer returns to the starting area.

2. A starting assist device for supportingly assisting backstroke swimmers during the initial, starting push-off from a swimming pool wall, comprising:

(A) an elongated wedge-like member incorporating (a) a pool abutting portion incorporating at least one, substantially planar, pool abutting surface extending between the edges of the wedge-like member, and (b) a foot engaging support portion incorporating at least one, substantially planar, foot engaging support surface extending between the edges of the wedge-like member and interconnected with the pool abutting surface at an acute angle thereto; and (B) at least one side member securely mounted between the pool abutting portion and the support portion, imparting rigidity thereto.

3. The starting assist device defined in claim 2, wherein said device is further defined as being removably mountable in the swimming pool.

4. The starting assist device defined in claim 2, wherein said device is further defined as comprising:

(C) a support assembly for securely positioning and holding the device in the desired location.

5. The starting assist device defined in claim 4, wherein said support assembly is further defined as comprising a. supporting rods securely mounted to and extending from said side member, and b. a holding strap securely mounted about said support rods and extending therefrom to a remote secured location, whereby the starting assist device is quickly and easily positioned and removed from its desired location inside the pool.

6. The starting assist device defined in claim 5, wherein said supporting strap is further defined as being adjustable.

7. The starting assist device defined in claim 4, wherein said support assembly is further defined as comprising (a) clip receiving members securely mounted to and extending from the side member, and (b) clip holding means cooperatively interconnectable with said clip receiving members and extending therefrom to a remote secure location.

8. The starting assist device defined in claim 4, wherein said support assembly is further defined as comprising a holding strap securely mounted to the wedge-like member, adjacent both of its ends, along the intersection of the pool abutting surface with the foot engaging support surface.

9. The starting assist device defined in claim 3, wherein the wedge-like member is further defined as incorporating two apertures near the terminating ends of the intersection of the pool abutting surface and the foot engaging support surface, and the holding strap is further defined as extending through the apertures and being securely engaged therewith.

10. The starting assist device defined in claim 2, wherein the side member is further defined as comprising at least two side members securely mounted to the pool abutting surface and the support surface along the edges thereof.

11. The starting assist device defined in claim 2, wherein said device is further defined as comprising (C) a non-slip surface securely mounted to said support surface, providing the swimmer with added assurance and protection against slipping.

12. The starting assist device defined in claim 2, wherein said angle between the support surface and pool abutting surface is further defined as comprising between about 10 and 80 degrees.

13. The starting assist device defined in claim 2, wherein said device comprises non-corrosive material.

14. A device for supportingly assisting backstroke swimmers during the initial, starting push-off from a swimming pool wall comprising:

A. an elongated sheet of non-corrosive material formed into a substantially triangular shape comprising
   a. a pool abutting surface as one side of the triangle, and
   b. a support surface forming a second side of the triangle adjacent the pool abutting surface and forming an acute angle therewith;

B. two side members
   a. securely mounted along both terminated edges of said sheet material, and
   b. extending between the pool abutting surface and the support surface;

C. a support assembly for securely positioning and holding the device in its desired location comprising:
   a. supporting members mounted to and extending from the side members, and
   b. holding means connected to said supporting members and extending therefrom to a remote secured location; and D. non-slip material bonded to the support surface, providing added protection against slipping whereby said device is quickly and easily positioned in and removed from a swimming pool to aid the backstroke swimmer during the start of his swim by firmly and securely supporting the swimmer's feet and preventing accidental slipping.

15. A starting assist device for supportingly assisting backstroke swimmers during the initial starting push-off from a swimming pool wall and adapted for removable positioning in the swimming pool comprising:

(A) an elongated, foot supporting plate
   (a) positionable with its top edge substantially horizontally extending along the vertical wall of the swimming pool,
   (b) having a horizontal length greater than its vertical width for easy supporting positioning of both feet on the elongated plate with any desired distance between the feet, and
   (c) mountable at an acute angle with the vertical wall of the swimming pool with the apex of the angle along the top edge of the elongated plate, and (B) support engaging means formed on the elongated plate for cooperative interconnection with a plate holding member whereby the elongated plate is securely held in position in a swimming pool providing foot engaging support to the backstroke swimmer when needed and quickly removable when not needed.

16. A starting assist device for supportingly assisting backstroke swimmers during the initial, starting push-off from a swimming pool wall and adapted for removable positioning in the swimming pool, comprising:

(A) a foot supporting member
   (a) positionable in juxtaposed spaced relationship with the vertical wall of the swimming pool, and
   (b) having a foot engaging surface for supportingly holding a portion of the swimmer's foot at an acute angle to the vertical wall of the swimming pool;

(B) means for securely holding the foot supporting member in position in the swimming pool; and (C) means for permitting removal of the foot supporting member from the swimming pool within ten seconds.

17. The starting assist device defined in claim 16, wherein the holding means and the means for permitting removal comprise a single member.

* * * * *